US007326105B2

(12) United States Patent
Chandrasekaran

(10) Patent No.: US 7,326,105 B2
(45) Date of Patent: Feb. 5, 2008

(54) RETAINING RINGS, AND ASSOCIATED PLANARIZING APPARATUSES, AND RELATED METHODS FOR PLANARIZING MICRO-DEVICE WORKPIECES

(75) Inventor: Nagasubramaniyan Chandrasekaran, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 10 days.

(21) Appl. No.: 11/217,151

(22) Filed: Aug. 31, 2005

(65) Prior Publication Data

US 2007/0049179 A1 Mar. 1, 2007

(51) Int. Cl.
*B24B 1/00* (2006.01)

(52) U.S. Cl. ..... 451/285; 451/398

(58) Field of Classification Search ..... 451/41, 451/285, 289, 397, 398, 287, 402
See application file for complete search history.

(56) References Cited

U.S. PATENT DOCUMENTS

| | | | |
|---|---|---|---|
| 5,069,002 | A | 12/1991 | Sandhu et al. |
| 5,081,796 | A | 1/1992 | Schultz |
| 5,232,875 | A | 8/1993 | Tuttle et al. |
| 5,234,867 | A | 8/1993 | Schultz et al. |
| 5,240,552 | A | 8/1993 | Yu et al. |
| 5,244,534 | A | 9/1993 | Yu et al. |
| 5,245,790 | A | 9/1993 | Jerbic |
| 5,245,796 | A | 9/1993 | Miller et al. |
| RE34,425 | E | 11/1993 | Schultz |
| 5,421,769 | A | 6/1995 | Schultz et al. |
| 5,433,651 | A | 7/1995 | Lustig et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,533,924 | A | 7/1996 | Stroupe et al. |
| 5,540,810 | A | 7/1996 | Sandhu et al. |
| 5,618,381 | A | 4/1997 | Doan et al. |
| 5,643,060 | A | 7/1997 | Sandhu et al. |
| 5,658,183 | A | 8/1997 | Sandhu et al. |
| 5,658,190 | A | 8/1997 | Wright et al. |
| 5,664,988 | A | 9/1997 | Stroupe et al. |
| 5,679,065 | A | 10/1997 | Henderson |
| 5,695,392 | A | 12/1997 | Kim |

(Continued)

OTHER PUBLICATIONS

Kondo, Seiichi, et al., "Abrasive-Free Polishing for Copper Damascene Interconnection," Journal of the Electrochemical Society, vol. 147, No. 10, pp. 3907-3913, 2000.

*Primary Examiner*—Jacob K. Ackun, Jr.
(74) *Attorney, Agent, or Firm*—Perkins Coie LLP

(57) ABSTRACT

Retaining rings and associated planarizing apparatuses, and related methods for planarizing micro-device workpieces are disclosed herein. A carrier head configured in accordance with one embodiment of the invention can be used to retain a micro-device workpiece during mechanical or chemical-mechanical polishing. In this embodiment, the carrier head can include a retaining ring carried by a workpiece holder. The retaining ring can include an inner surface, an outer surface, and a base surface extending at least partially between the inner and outer surfaces. The retaining ring can further include at least one annular groove and a plurality of transverse grooves. The annular groove can be positioned adjacent to the base surface between the inner and outer surfaces. The plurality of transverse grooves can extend from the inner surface of the retaining ring to the annular groove in the base surface.

34 Claims, 5 Drawing Sheets

U.S. PATENT DOCUMENTS 5,702,292 A 12/1997 Brunelli et al.
5,730,642 A 3/1998 Sandhu et al.
5,747,386 A 5/1998 Moore
5,792,709 A 8/1998 Robinson et al.
5,795,495 A 8/1998 Meikle
5,807,165 A 9/1998 Uzoh et al.
5,830,806 A 11/1998 Hudson et al.
5,851,135 A 12/1998 Sandhu et al.
5,868,896 A 2/1999 Robinson et al.
5,882,248 A 3/1999 Wright et al.
5,893,754 A 4/1999 Robinson et al.
5,895,550 A 4/1999 Andreas
5,930,699 A 7/1999 Bhatia
5,934,980 A 8/1999 Koos et al.
5,944,593 A 8/1999 Chiu et al.
5,945,347 A 8/1999 Wright
5,954,912 A 9/1999 Moore
5,967,030 A 10/1999 Blalock
5,972,792 A 10/1999 Hudson
5,980,363 A 11/1999 Meikle et al.
5,981,396 A 11/1999 Robinson et al.
5,994,224 A 11/1999 Sandhu et al.
5,997,384 A 12/1999 Blalock
6,004,193 A 12/1999 Nagahara et al.
6,039,633 A 3/2000 Chopra
6,040,245 A 3/2000 Sandhu et al.
6,054,015 A 4/2000 Brunelli et al.
6,066,030 A 5/2000 Uzoh
6,074,286 A 6/2000 Ball
6,083,085 A 7/2000 Lankford
6,110,820 A 8/2000 Sandhu et al.
6,116,988 A 9/2000 Ball
6,120,354 A 9/2000 Koos et al.
6,125,255 A 9/2000 Litman et al.
6,135,856 A 10/2000 Tjaden et al.
6,139,402 A 10/2000 Moore
6,143,123 A 11/2000 Robinson et al.
6,143,155 A 11/2000 Adams et al.
6,152,808 A 11/2000 Moore
6,176,992 B1 1/2001 Talieh
6,180,525 B1 1/2001 Morgan
6,183,350 B1 2/2001 Lin et al.
6,187,681 B1 2/2001 Moore
6,191,037 B1 2/2001 Robinson et al.
6,193,588 B1 2/2001 Carlson et al.
6,200,901 B1 3/2001 Hudson et al.
6,203,404 B1 3/2001 Joslyn et al.
6,203,413 B1 3/2001 Skrovan
6,206,756 B1 3/2001 Chopra et al.
6,210,257 B1 4/2001 Carlson
6,213,845 B1 4/2001 Elledge
6,218,316 B1 4/2001 Marsh
6,224,472 B1 * 5/2001 Lai et al. ..... 451/398
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,245,193 B1 * 6/2001 Quek et al. ..... 156/345.14
6,250,994 B1 6/2001 Chopra et al.
6,251,785 B1 6/2001 Wright
6,261,151 B1 7/2001 Sandhu et al.
6,261,163 B1 7/2001 Walker et al.
6,267,643 B1 * 7/2001 Teng et al. ..... 451/41
6,267,650 B1 7/2001 Hembree
6,267,655 B1 7/2001 Weldon et al.
6,273,786 B1 8/2001 Chopra et al.
6,273,796 B1 8/2001 Moore
6,276,996 B1 8/2001 Chopra
6,284,660 B1 9/2001 Doan
6,306,012 B1 10/2001 Sabde
6,306,014 B1 10/2001 Walker et al.
6,306,768 B1 10/2001 Klein
6,312,558 B2 11/2001 Moore
6,328,632 B1 12/2001 Chopra
6,331,488 B1 12/2001 Doan et al.
6,350,180 B2 2/2002 Southwick
6,350,691 B1 2/2002 Lankford
6,352,466 B1 3/2002 Moore
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,417 B2 3/2002 Walker et al.
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,376,381 B1 4/2002 Sabde
6,383,934 B1 5/2002 Sabde et al.
6,387,289 B1 5/2002 Wright
6,395,620 B1 5/2002 Pan et al.
6,402,884 B1 6/2002 Robinson et al.
6,419,567 B1 * 7/2002 Glashauser ..... 451/259
6,428,386 B1 8/2002 Bartlett
6,447,369 B1 9/2002 Moore
6,447,380 B1 9/2002 Pham et al.
6,498,101 B1 12/2002 Wang
6,511,576 B2 1/2003 Klein
6,520,834 B1 2/2003 Marshall
6,533,893 B2 3/2003 Sabde et al.
6,547,640 B2 4/2003 Hofmann
6,548,407 B1 4/2003 Chopra et al.
6,579,799 B2 6/2003 Chopra et al.
6,592,443 B1 7/2003 Kramer et al.
6,609,947 B1 8/2003 Moore
6,623,329 B1 9/2003 Moore
6,648,734 B2 11/2003 Chin et al.
6,652,764 B1 11/2003 Blalock
6,666,749 B2 12/2003 Taylor
6,821,192 B1 11/2004 Donohue
6,835,125 B1 * 12/2004 Tseng et al. ..... 451/398
6,869,335 B2 3/2005 Taylor
7,118,456 B2 10/2006 Moloney et al.
2002/0017365 A1 * 2/2002 Gunji et al. ..... 156/345
2002/0182867 A1 * 12/2002 Kajiwara et al. ..... 438/692
2005/0037694 A1 * 2/2005 Taylor ..... 451/41
2005/0113002 A1 * 5/2005 Chen et al. ..... 451/42
2006/0137819 A1 * 6/2006 Manens et al. ..... 156/345.12

* cited by examiner

RETAINING RINGS, AND ASSOCIATED PLANARIZING APPARATUSES, AND RELATED METHODS FOR PLANARIZING MICRO-DEVICE WORKPIECES

TECHNICAL FIELD

The following disclosure relates generally to mechanical and/or chemical-mechanical planarization of micro-device workpieces and, more particularly, to retaining rings for use with planarizing apparatuses.

BACKGROUND

Mechanical and chemical-mechanical planarization processes (collectively "CMP") remove material from the surface of micro-device workpieces in the production of microelectronic devices and other products. FIG. 1 schematically illustrates a typical CMP machine 10 for performing a chemical-mechanical planarization process. The CMP machine 10 includes a platen 20, a carrier head 30, and a planarizing pad 40. The CMP machine 10 can also include an under-pad 25 positioned between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Because the planarizing pad 40 is attached to the under-pad 25, the planarizing pad 40 moves with the platen 20 during planarization.

A micro-device workpiece 12 can be attached to a lower surface 32 of the carrier head 30, or to a resilient pad 34 under the lower surface 32. The carrier head 30 may be a weighted, free-floating wafer carrier, or an actuator assembly 36 can be attached to the carrier head 30 to impart rotational motion to the micro-device workpiece 12 (indicated by arrow J) and/or reciprocate the workpiece 12 back and forth (indicated by arrow 1).

The planarizing pad 40 and a planarizing solution 44 define a planarizing medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" non-abrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the micro-device workpiece 12 with the CMP machine 10, the carrier head 30 presses the workpiece 12 face-downward against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the workpiece 12 against the planarizing surface 42. As the micro-device workpiece 12 rubs against the planarizing surface 42, the planarizing medium removes material from the face of the workpiece 12.

The force generated by friction between the micro-device workpiece 12 and the planarizing pad 40 during planarization will, at any given instant, be exerted against the workpiece 12 primarily in the direction of relative movement between the workpiece 12 and the planarizing pad 40. A retaining ring 33 can be used to counteract this force and hold the micro-device workpiece 12 in position. The retaining ring 33 extends downwardly from the carrier head 30 and contacts the planarizing surface 42 around the micro-device workpiece 12.

The planarity of the finished micro-device workpiece surface is a function of the distribution of planarizing solution 44 under the workpiece 12 during planarization and several other factors. The distribution of planarizing solution 44 is a controlling factor for the distribution of abrasive particles and chemicals under the workpiece 12, as well as a factor affecting the temperature distribution across the workpiece 12. In certain applications it is difficult to control the distribution of planarizing solution 44 under the micro-device workpiece 12 because the retaining ring 33 wipes some of the solution 44 off of the planarizing pad 40. Moreover, the retaining ring 33 can prevent proper exhaustion of the planarizing solution 44 from inside the retaining ring 33, causing a build-up of the planarizing solution 44 proximate to the trailing edge. These problems cause an uneven distribution of abrasive particles and chemicals under the micro-device workpiece that result in non-uniform and uncontrollable polishing rates across the workpiece.

To solve this problem, some retaining rings have grooves. These retaining rings, however, may not be very effective at exhausting the planarizing solution. Various examples of retaining rings with grooves are described in detail in U.S. Pat. No. 6,869,335 to Taylor; U.S. Pat. No. 6,224,472 to Lai et al.; U.S. Pat. No. 6,267,643 to Teng et al.; U.S. Pat. No. 5,944,593 to Chiu et al.; and U.S. Patent Publication No. 2002/0182867 of Kajiwara et al., published Dec. 5, 2002. Each of these patents and the patent publication is incorporated in the present application in its entirety by reference.

FIG. 2 schematically illustrates another rotary CMP machine 110 with a first platen 120*a*, a second platen 120*b*, a first carrier head 130*a*, and a second carrier head 130*b*. On the CMP machine 110, the first carrier head 130*a* rotates in a first direction $D_1$, and the second carrier head 130*b* rotates in a second direction $D_2$. Because the carrier heads 130*a-b* rotate in different directions, retaining rings with different grooves are used for each carrier head 130*a-b*. The use of two different retaining rings increases inventory costs and can result in the wrong ring being placed on a carrier head 130.

SUMMARY

This summary is provided for the benefit of the reader only, and is not intended to limit the invention as set forth by the claims.

The present invention relates to retaining rings and associated planarizing apparatuses, and related methods for planarizing micro-device workpieces. A carrier head configured in accordance with one aspect of the invention can be used to retain a micro-device workpiece during mechanical or chemical-mechanical polishing. The carrier head can include a retaining ring carried by a workpiece holder. The retaining ring can include an inner annular surface, an outer annular surface, and a base surface extending at least partially between the inner and outer surfaces. In addition, the retaining ring can further include an annular groove and a plurality of transverse grooves. The annular groove can be positioned adjacent to the base surface between the inner and outer surfaces. The plurality of transverse grooves can extend from the inner surface to the annular groove. In one embodiment, each of the transverse grooves can intersect the annular groove at an angle of about 90°. In another embodiment, one or more of the transverse grooves can intersect the annular groove at an oblique angle.

A carrier head configured in accordance with another aspect of the invention includes a retaining ring carried by a workpiece holder. The retaining ring can include an inner wall, an outer wall, and a base surface extending at least partially between the inner and outer walls. The base surface can include an annular channel, a first plurality of transverse channels, and a second plurality of transverse channels. The first and second pluralities of transverse channels can extend from the inner wall of the annular ring to the annular channel. Further, the first plurality of transverse channels can be configured to pump a planarizing solution into the retaining ring when the retaining ring is rotated in a first direction, and the second plurality of transverse channels can be configured to exhaust the planarizing solution from the retaining ring when the retaining ring is rotated in the first direction. In one embodiment, one or more of the transverse channels can extend all the way across the base surface of the retaining ring from the inner wall to the outer wall. In another embodiment, the annular channel can be a first annular channel, and the retaining ring can further include a second annular channel positioned adjacent to the first annular channel.

A machine for polishing micro-device workpieces in accordance with a further aspect of the invention can include a table, a planarizing pad coupled to the table, and a workpiece carrier assembly having a drive system operably coupled to a carrier head. The carrier head can include a retaining ring carried by a workpiece holder. The retaining ring can include an inner surface, an outer surface, and a base surface extending at least partially between the inner and outer surfaces. The retaining ring can also include an annular groove positioned adjacent to the base surface between the inner and outer surfaces, and a plurality of transverse grooves extending at least from the inner surface to the annular groove.

A method of polishing a micro-device workpiece in accordance with another aspect of the invention can include positioning the workpiece proximate to an inner surface of a retaining ring, and applying a solution to a polishing pad. The method can further include rotating the retaining ring relative to the polishing pad in a first direction, and passing at least a portion of the solution from the inner surface of the retaining ring to an annular groove in the retaining ring through at least one transverse groove in the retaining ring. In one embodiment, the transverse groove can be a first transverse groove having a first orientation in the retaining ring, and the method can further include passing at least a portion of the solution from the annular groove to the inner surface through at least a second transverse groove in the retaining ring. In this embodiment, the second transverse groove can have a second orientation in the retaining ring that is different than the first orientation.

DETAILED DESCRIPTION

The present invention is directed generally to retaining rings, associated planarizing apparatuses, and related methods for mechanical and/or chemical-mechanical planarization of micro-device workpieces. The term "micro-device workpiece" is used throughout the present disclosure to refer to substrates upon which or in which microelectronic devices, micromechanical devices, data storage elements, and other features can be fabricated. Such micro-device workpieces can include, for example, semi-conductor wafers, glass substrates, insulated substrates, etc. Furthermore, the terms "planarization" and "planarizing" can refer to forming a planar and/or smooth surface (e.g., "polishing"). Moreover, the term "transverse" can mean oblique, perpendicular, and/or not parallel.

Specific details are set forth in the following description and in FIGS. 3A-9 to provide a thorough understanding of various embodiments of the invention. One skilled in the art will understand, however, that the present invention may have additional embodiments, or that other embodiments of the invention can be practiced without several of the specific features described below.

Figure 1:
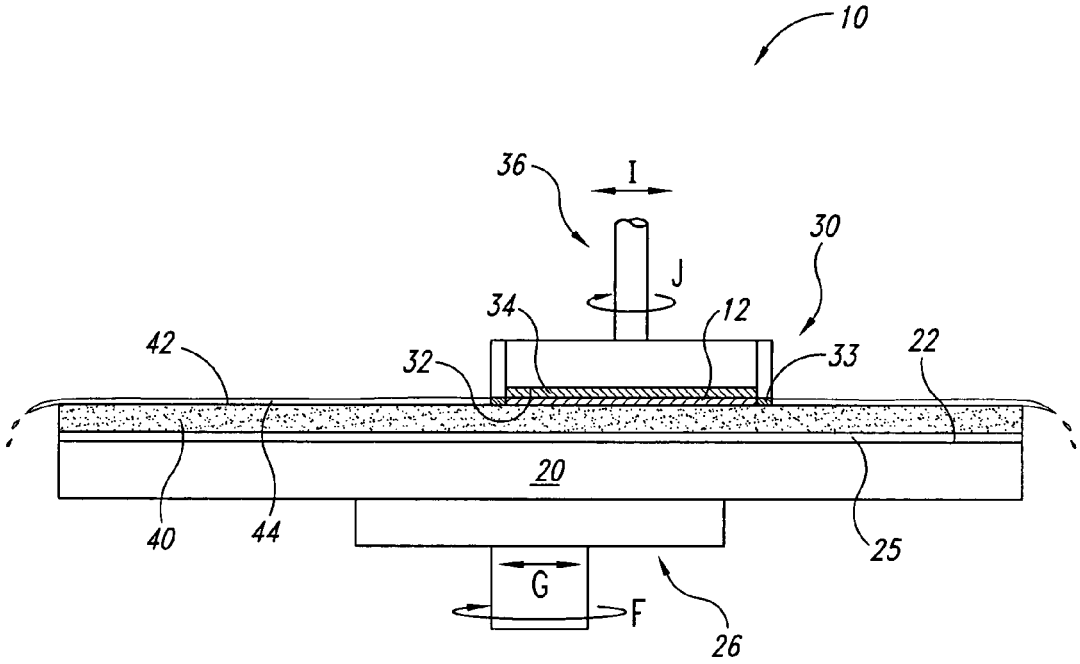
Fig. 1 (Prior Art)
FIG. 1 is a schematic cross-sectional view illustrating a portion of a rotary planarizing machine configured in accordance with the prior art.
Figure 3A:
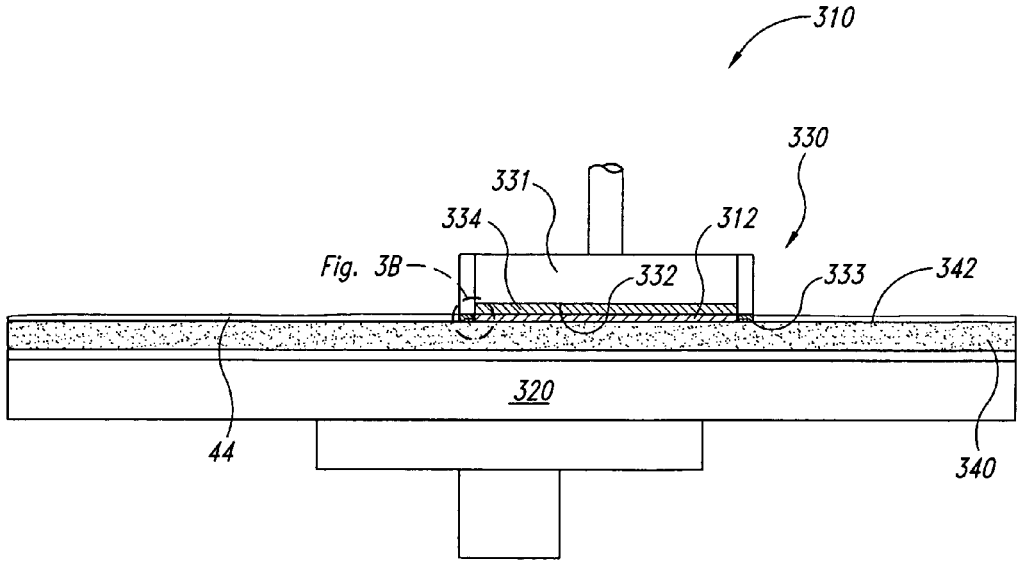
FIG. 3A is a schematic cross-sectional view illustrating a portion of a rotary planarizing machine having a carrier head with a retaining ring configured in accordance with an embodiment of the invention.

FIG. 3A is an elevation view schematically illustrating a rotary CMP machine 310 with a table or platen 320, a carrier head 330, and a planarizing pad 340. The platen 320 can be a stationary platen or a rotary platen. The platen 320 and the pad 340 can be similar in structure and function to the platen 20 and the pad 40 described above with reference to FIG. 1. For example, the pad 340 can have a planarizing surface 342 upon which a micro-device workpiece 312 is planarized in the presence of a slurry or another type of planarizing solution 44.

In one aspect of this embodiment, the carrier head 330 includes a workpiece holder or carrier 331. The workpiece carrier 331 includes a lower surface 332 to which a backing member 334 is attached. The micro-device workpiece 312 is positioned between the backing member 334 and the planarizing pad 340. The backing member 334 can be operably coupled to a movable back plate, membrane, and/or other apparatus configured to selectively exert a downward force upon the micro-device workpiece 312 during planarization. In other embodiments, the backing member 334 can be omitted and the micro-device workpiece 312 can be attached to the lower surface 332 of the workpiece carrier 331.

In another aspect of this embodiment, the carrier head 330 further includes a retaining ring 333 configured to prevent the micro-device workpiece 312 from slipping relative to the workpiece carrier 331 during the planarizing process. In the illustrated embodiment, the retaining ring 333 is circular and extends around the outside of the micro-device workpiece 312 to hold the micro-device workpiece 312 in position as the workpiece carrier 331 rubs it against the pad 340. The retaining ring 333 can have a diameter greater than the micro-device workpiece 312 if desirable to allow the workpiece 312 to precess relative to the workpiece carrier 331 during the planarizing process.

The retaining ring 333 can be configured to move upwardly and downwardly relative to the workpiece carrier 331 if needed to adjust the relative pressures exerted by the retaining ring 333 and the micro-device workpiece 312 against the pad 340. Adjusting these pressures may be necessary and/or advantageous to maintain an adequate hold on the micro-device workpiece 312 during planarization while at the same time providing a superior surface finish. For example, in one embodiment of the present invention, the retaining ring 333 can be configured to exert a ring pressure against the pad 340 which is equal to about twice a pad pressure exerted by the micro-device workpiece 312 against the pad 340. In other embodiments, the ring pressure and the pad pressure can have other relative values. For example, in one other embodiment described in greater detail below, the ring pressure can be reduced relative to the pad pressure such that the ratio is less than 2:1, such as about 1.5:1. Reducing ring pressure in this manner can advantageously reduce pad glazing and wear, particle generation, and workpiece edge defects resulting from pad rebound.

Figure 3B:
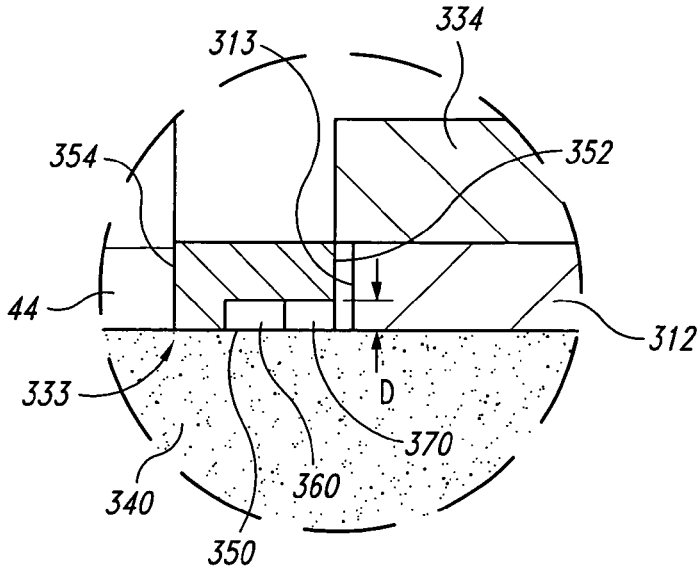
FIG. 3B is an enlarged cross-sectional view of a portion of the retaining ring of FIG. 3A.

FIG. 3B is a enlarged cross-sectional view illustrating a portion of the retaining ring 333 in greater detail. The retaining ring 333 includes a base surface 350 extending at least partially between an inner surface 352 and an outer surface 354. The micro-device workpiece 312 is positioned within the retaining ring 333 such that an outer edge 313 of the micro-device workpiece 312 is positioned proximate to the inner surface 352 of the retaining ring 333. The inner surface 352 is thereby able to exert a force against the outer edge 313 as needed to retain the micro-device workpiece 312 in the proper position during polishing.

Figure 2:
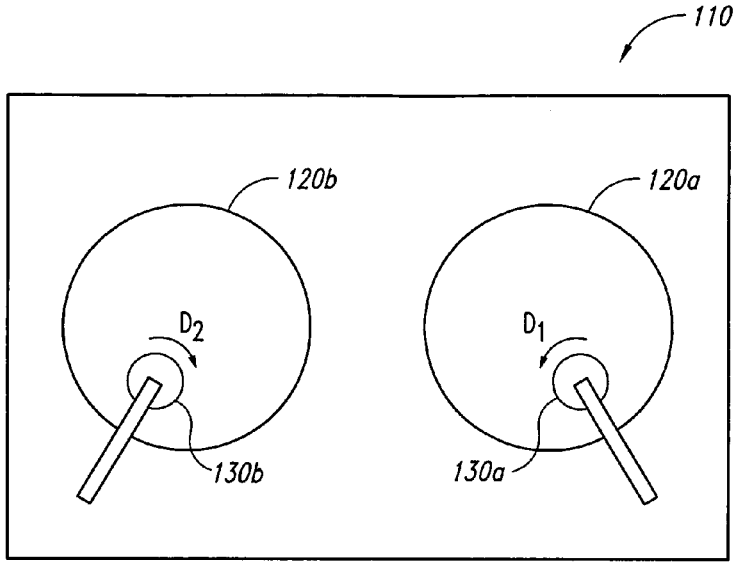
Fig. 2 (Prior Art)
FIG. 2 is a top plan view illustrating a portion of another rotary planarizing machine configured in accordance with the prior art.

The base surface 350 of the retaining ring 333 contacts the planarizing solution 44 and the planarizing pad 340. As a result, the outer surface 354 and the base surface 350 sweep the planarizing solution 44 across the pad 340 during the planarizing process. With conventional retaining rings (such as the retaining rings described above with reference to FIGS. 1 and 2), this sweeping effect often prevents the planarizing solution 44 from sufficiently entering and/or exiting the wafer cavity during the planarizing process. As described in greater detail below, however, the retaining ring 333 of the present invention can include at least one annular channel or groove 360 and a plurality of transverse channels or grooves 370 (only one transverse groove is shown in FIG. 3B) to facilitate the flow of planarizing solution 44 into and/or out of the wafer cavity during planarization.

Figure 4:
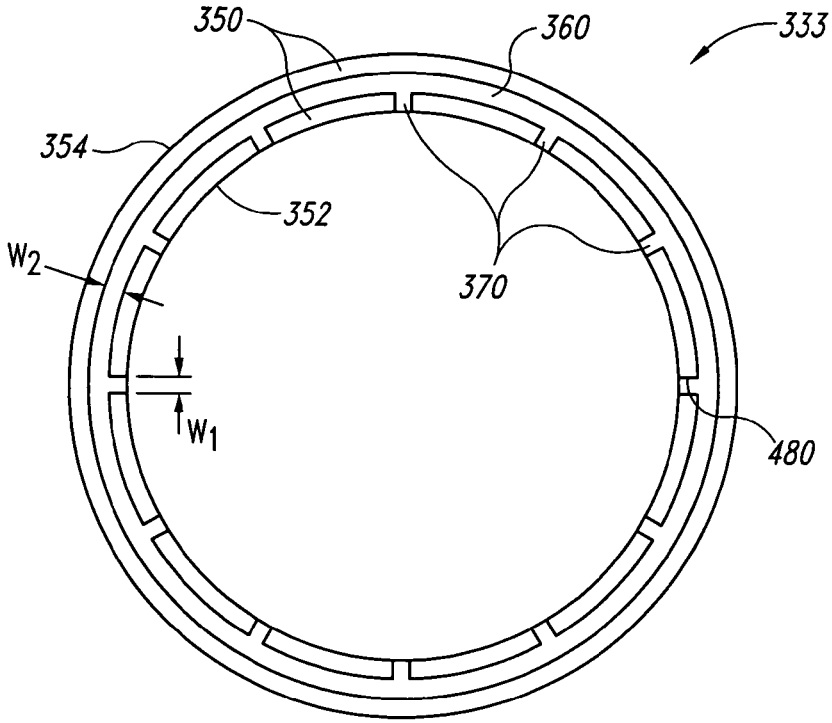
FIG. 4 is a bottom plan view of the retaining ring of FIGS. 3A and 3B.

FIG. 4 is a bottom plan view of the retaining ring 333 of FIGS. 3A and 3B configured in accordance with an embodiment of the invention. In the illustrated embodiment, the transverse grooves 370 are uniformly spaced around the retaining ring 333 and extend from the inner surface 352 to the annular groove 360. Furthermore, in this particular embodiment the transverse grooves 370 are at least approximately straight and intersect the annular groove 360 at right angles (e.g., radial with respect to the ring 333). In other embodiments described in detail below, however, the retaining ring 330 or various embodiments thereof can include a plurality of transverse grooves extending in various curved paths and/or intersecting the annular groove 360 at various oblique angles. Regardless of groove orientation, the intersection of the base surface 350 with one or more groove sidewalls 480 can be beveled, rounded, etc. to avoid excessive wear to the planarizing pad 340 (FIG. 2) during the planarizing process.

In the illustrated embodiment, the tranverse grooves 370 can have a first width $W_1$ of about 0.025 inch and a corresponding depth D (FIG. 3) of about 0.025 inch. The annular groove 360 can have a width of $W_2$ of about 0.025 inch and a corresponding depth D of about 0.025 inch. In other embodiments, the widths W and the depth D of the transverse grooves 370 and the annular groove 360 can have other dimensions as required to provide desirable planarizing characteristics.

Figure 5:
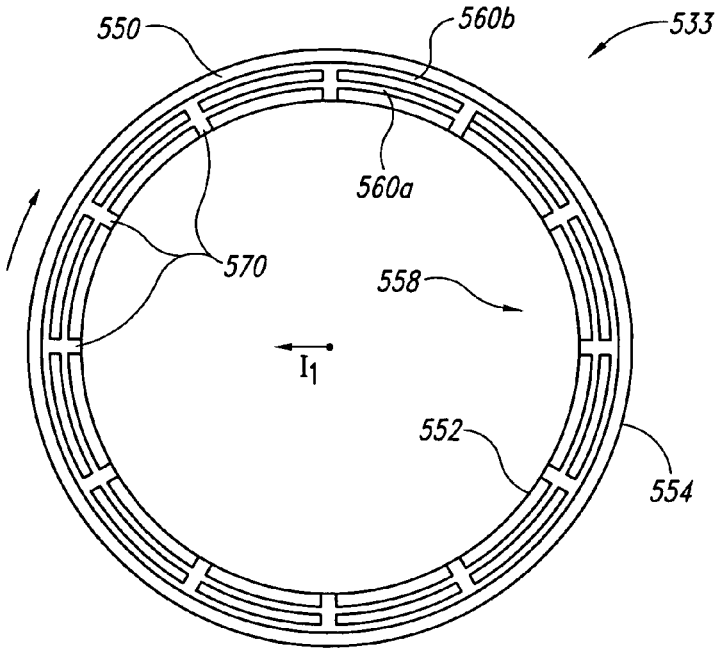
FIG. 5 is a bottom plan view of a retaining ring configured in accordance with another embodiment of the invention.

FIG. 5 is a bottom plan view of a retaining ring 533 configured in accordance with another embodiment of the invention. Many features of the retaining ring 533 are at least generally similar in structure and function to the retaining ring 333 described above with reference to FIGS. 3A-4. In this particular embodiment, however, the retaining ring 533 includes a first annular groove 560*a* and an adjacent second annular groove 560*b* formed in a base surface 550. In addition, transverse grooves 570 extend outwardly from an inner surface 552 of the retaining ring 533 and intersect both the first annular groove 560*a* and the second annular groove 560*b*. In the illustrated embodiment, the transverse grooves 570 terminate before reaching an outer surface 554 of the retaining ring 533. In other embodiments described in greater detail below, however, the transverse grooves can extend all the way across the base surface of the retaining ring.

During the planarizing process, the annular grooves 560 (and 360 in FIG. 4) can act as planarizing solution reservoirs that prevent the planarizing solution 44 (FIG. 3B) from accumulating along a trailing edge 558 of the retaining ring 533 as the retaining ring 533 moves in a linear direction $I_1$. In addition, the transverse grooves 570 can act as transport channels that direct the planarizing solution 44 into and/or out of the annular grooves 560 as required to maintain a relatively even distribution of planarizing solution 44 on the planarizing pad 340 in the wafer cavity. Controlling the amount of planarizing solution 44 applied to the micro-device workpiece 312 in this manner can lead to better planarity results from the polishing process. Further, the planarizing rate can be improved by controlling planarizing solution transport to the workpiece cavity.

Another expected advantage of the embodiments illustrated in FIGS. 4 and 5 is that the annular groove (or grooves) in the retaining rings can control pad rebound during the planarizing process. Controlling the extent and location of pad rebound can help to minimize surface variations and control the edge profile of the micro-device workpiece during the planarizing process. Yet another expected advantage of the illustrated embodiments is that the relative pressure exerted against the planarizing pad 340 by the retaining ring 533 can be reduced without increasing the likelihood of work-piece slippage. This can reduce wear and/or glazing of the planarizing pad 340, while also reducing generation of pad debris. Yet another expected advantage of the annular grooves disclosed herein is that they lower the impeded transport distance for slurry moving into or out of the planarizing cavity, in contrast to other retaining rings wherein the planarizing solution must pass beneath the full width of the retaining ring base surface.

Figure 6A:
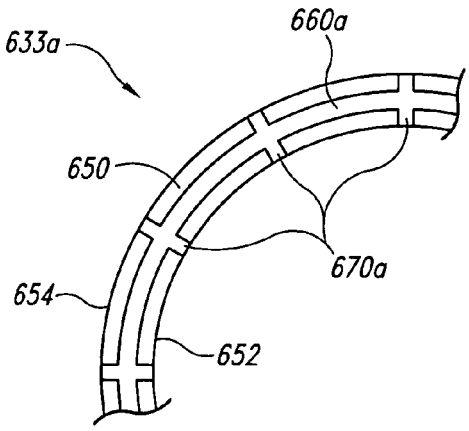
FIGS. 6A and 6B are bottom plan views of portions of retaining rings configured in accordance with further embodiments of the invention.
Figure 6B:
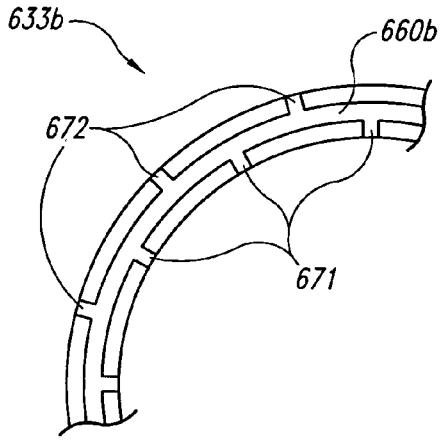

Although the transverse grooves 370 and 570 described above with reference to FIGS. 4 and 5 do not extend all the way across the base surfaces of the respective retaining rings 333 and 533, retaining rings configured in accordance with other embodiments of the invention can include one or more transverse grooves that do extend all the way across the base surface. Examples of such retaining rings are illustrated in FIGS. 6A and 6B. Referring first to FIG. 6A, a retaining ring 633*a* includes an annular groove 660*a* and a plurality of transverse grooves 670*a* that extend across the full width of a base surface 650 from an inner surface 652 to an outer surface 654. In FIG. 6A, the transverse grooves 670*a* extend in a relatively straight path across the base surface 650. In contrast, FIG. 6B illustrates a retaining ring 633*b* having a plurality of first transverse grooves 671 that are staggered relative to a corresponding plurality of second transverse grooves 672.

Figure 7:
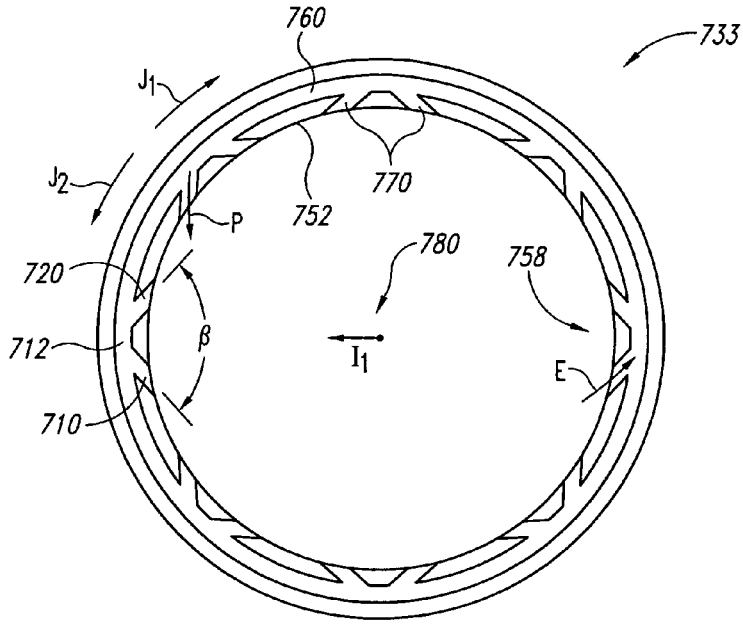
FIG. 7 is a bottom plan view of a portion of a retaining ring configured in accordance with another embodiment of the invention.

FIG. 7 is a bottom plan view of a retaining ring 733 configured in accordance with another embodiment of the invention. The retaining ring 733 includes a plurality of transverse grooves 770 that extend from an inner surface 752 to an annular groove 760. In the illustrated embodiment, the transverse grooves 770 include a plurality of first grooves 710 and a plurality of corresponding second grooves 720. Each first groove 710 intersects the adjacent second groove 720 at a point of intersection 712 proximate to the annular groove 760. Further, each first groove 710 forms an angle β with the adjacent second groove 720. In one embodiment, the angle β can be about 110°. In other embodiments, the angle β can be equal to or greater than 60° and/or less than 180°. In still further embodiments, some of the groove pairs can include transverse grooves that intersect at different angles.

The orientation of the transverse grooves 770 can prevent the planarizing solution 44 (FIG. 3) from accumulating against a trailing edge 758 of the retaining ring 733 during planarization. For example, as the retaining ring 733 rotates in a first direction $J_1$ and translates in a linear direction $I_1$, the planarizing solution 44 and associated abrasive particles in a wafer cavity 780 can flow into the annular groove 760 through the second grooves 720 along path E. This allows for proper exhaustion of excess planarizing solution 44 from the wafer cavity 780. Similarly, this same motion of the retaining ring 733 can cause the planarizing solution 44 in the annular groove 760 to flow back into the wafer cavity 780 through the first grooves 710 along path P. This allows for proper distribution of the planarizing solution in the wafer cavity 780 for contact with the micro-device workpiece 312 (FIG. 3) during the planarizing process. In the foregoing manner, the orientation of the transverse grooves 770 allows for a more even distribution of the planarizing solution 44 during the planarizing process by preventing accumulation of the planarizing solution 44 proximate to the inside of the trailing edge 758 of the retaining ring 733.

Another expected advantage of the illustrated embodiment is that the retaining ring 733 will function properly regardless of the direction of rotation. For example, when the retaining ring 733 is rotated in a second direction $J_2$, the planarizing solution 44 flows into the annular groove 760 through the first transverse grooves 710, and out of the annular groove 760 through the second transverse groove 720. Accordingly, the retaining ring 733 can be used with either workpiece carrier in those CMP machines having two or more carrier heads that counter rotate during the planarizing process. This versatility reduces inventory costs and the likelihood of placing the wrong retaining ring on a particular workpiece carrier.

Figure 8:
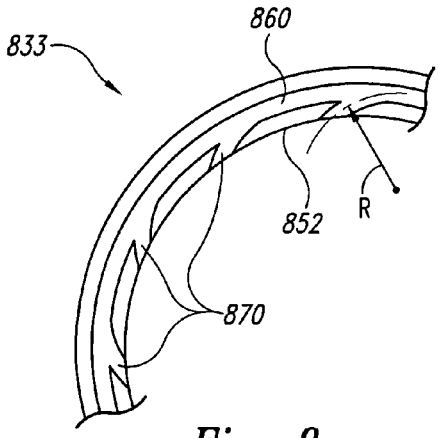
FIG. 8 is a bottom plan view of a portion of a retaining ring configured in accordance with a further embodiment of the invention.
Figure 9:
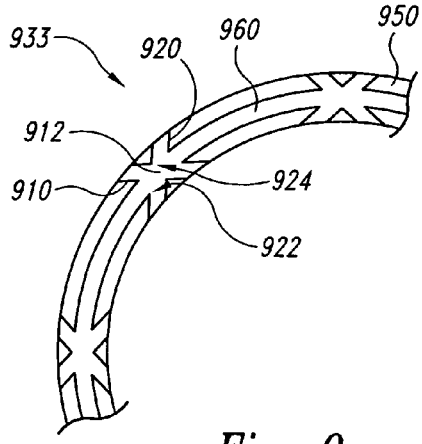
FIG. 9 is a bottom plan view of a portion of a retaining ring configured in accordance with another embodiment of the invention.

FIGS. 8 and 9 are bottom plan views of portions of retaining rings 833 and 933, respectively, configured in accordance with other embodiments of the invention. Referring first to FIG. 8, the retaining ring 833 includes an annular groove 860 and a plurality of transverse grooves 870. The transverse grooves 870 have a radius of curvature R, and extend from an inner surface 852 of the retaining ring 833 to the annular groove 860. One advantage of this configuration is that the curved transverse grooves 870 can facilitate transport of the planarizing solution 44 (FIG. 3) into and/or out of the retaining ring 833 during the planarizing process. Further, although all of the transverse grooves 870 illustrated in FIG. 8 intersect the annular groove 860 at the same angle, in other embodiments, the retaining ring 833 can include a plurality of transverse grooves which intersect the annular groove 860 at different angles.

Referring next to FIG. 9, the retaining ring 933 includes a first groove 910 and a second groove 920 that intersect at an intersection 912 proximate to an annular groove 960, thereby creating an "X" pattern. In the illustrated embodiment, the first groove 910 is oriented at an angle β with respect to the second groove 920. The intersection of the first groove 910 and the second groove 920 creates a plurality of corner points, (e.g., such as a first corner point 922 and a second corner point 924) on a base surface 950 of the retaining ring 933. Each of these corner points 922 and 924 can cause wear on the planarizing pad 340 (FIG. 3) as the retaining ring 933 moves relative to the planarizing pad 340 during the planarizing process. Accordingly, one advantage of the embodiments illustrated in FIGS. 3A-8 is that the number of corner points is reduced, thereby reducing the amount of wear and/or debris that is generated on the surface of the planarizing pad 340 during the planarizing process.

Although various retaining rings have been described above, in other embodiments of the invention, various features of these retaining rings can be combined or omitted to create other retaining rings configured in accordance with the present invention. These other retaining rings can include one or more annular grooves and one or more transverse grooves at similar or different orientations, and/or at different spacing around the retaining ring. Further, such rings can be made from a single piece of material or a plurality of pieces or sections of materia.

From the foregoing, it will be appreciated that specific embodiments of the invention have been described herein for purposes of illustration, but that various modifications may be made without deviating from the spirit and scope of the invention. For example, aspects of the invention described in the context of particular embodiments may be combined or eliminated in other embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited, except as by the appended claims.

I claim:

1. A carrier head for retaining a micro-device workpiece during at least one of mechanical polishing and chemical-mechanical polishing, the carrier head comprising:

a workpiece holder configured to receive the workpiece; and a retaining ring carried by the workpiece holder, the retaining ring including;

an inner surface;

an outer surface;

a base surface extending at least partially between the inner and outer surfaces;

an annular groove positioned adjacent to the base surface between the inner and outer surfaces; and a plurality of transverse grooves extending from the inner surface to the annular groove, wherein the plurality of transverse grooves includes at least a first transverse groove and an adjacent second transverse groove, wherein the first transverse groove intersects the annular groove at a first angle and the second transverse groove intersects the annular groove at a second angle different than the first angle, the transverse grooves terminating before reaching the outer surface.

2. The carrier head of claim 1 wherein the annular groove and each of the transverse grooves are formed in the base surface.

3. The carrier head of claim 1 wherein each of the transverse grooves intersects the annular groove at an angle different than 90 degrees.

4. The carrier head of claim 1 wherein the first transverse groove intersects the second transverse groove.

5. The carrier head of claim 1 wherein the plurality of transverse grooves include a plurality of first transverse grooves and a plurality of second transverse grooves arranged in groove pairs, and wherein each groove pair includes first and second transverse grooves that are at least substantially transverse to each other.

6. The carrier head of claim 1 wherein at least one of the transverse grooves is curved.

7. The carrier head of claim 1 wherein the annular groove is a first annular groove, and wherein the retaining ring further comprises a second annular groove positioned adjacent to the first annular groove in the base surface.

8. The carrier head of claim 1 wherein the annular groove is a first annular groove, wherein the retaining ring further comprises a second annular groove positioned adjacent to the first annular groove in the base surface, and wherein the plurality of transverse grooves intersect the first and second annular grooves.

9. The carrier head of claim 1 wherein the retaining ring further includes at least a third transverse groove that extends from the inner surface of the retaining ring to the outer surface of the retaining ring.

10. The carrier head of claim 1 wherein the retaining ring further includes a plurality of third transverse grooves extending from the outer surface to the annular groove.

11. A carrier head for retaining a micro-device workpiece during rotation in a solution, the carrier head comprising:

a workpiece holder configured to receive the workpiece; and a retaining ring carried by the workpiece holder, the retaining ring including:

an inner wall;

an outer wall; and a base surface extending at least partially between the inner and outer walls, the base surface having an annular channel, a first plurality of transverse channels, and a second plurality of transverse channels, the first and second pluralities of transverse channels extending from the inner wall to the annular channel and terminating before reaching the outer wall, wherein the first plurality of transverse channels is configured to pump the solution into the retaining ring when the retaining ring is rotated in a first direction, and wherein the second plurality of transverse channels is configured to exhaust the solution from the retaining ring when the retaining ring is rotated in the first direction.

12. The carrier head of claim 11 wherein each channel in the first plurality of transverse channels intersects a corresponding channel in the second plurality of transverse channels proximate to the inner wall of the retaining ring.

13. The carrier head of claim 11 wherein each channel in the first plurality of transverse channels is positioned at an angle of between 90 and 130 degrees relative to a corresponding channel in the second plurality of transverse channels.

14. The carrier head of claim 11 wherein at least one of the channels in the first plurality of channels is straight.

15. The carrier head of claim 11 wherein at least one of the channels in the first plurality of channels is curved.

16. The carrier head of claim 11 wherein the retaining ring further includes at least a third transverse channel extending from the inner wall of the retaining ring to the outer wall of the retaining ring.

17. The carrier head of claim 11 wherein the annular channel is a first annular channel, wherein the base surface of the retaining ring further includes a second annular channel, and wherein at least one of the first plurality of transverse channels and the second plurality of transverse channels intersect the first and second annular channels.

18. The carrier head of claim 11 wherein the first plurality of transverse channels is configured to exhaust the solution from the annular channel when the retaining ring is rotated in a second direction, and wherein the second plurality of transverse channels is configured to pump the solution into the annular channel when the retaining ring is rotated in the second direction.

19. A carrier head for retaining a micro-device workpiece during rotation in a solution, the carrier head comprising:

a workpiece holder configured to receive the workpiece; and a retaining ring carried by the workpiece holder, the retaining ring including:

an inner surface;

an outer surface;

a base surface extending at least partially between the inner surface and the outer surface, the base surface having an annular groove;

means for pumping the solution from the inner surface to the annular groove as the retaining ring rotates in a single direction; and means for concurrently exhausting the solution from the annular groove to the inner surface as the retaining ring rotates in the single direction.

20. The carrier head of claim 19 wherein the retaining ring further includes means for concurrently exhausting the solution from the annular groove to the outer surface as the retaining ring rotates in the single direction.

21. The carrier head of claim 19 wherein the means for pumping include a first channel and the means for exhausting include a second channel that intersects the first channel proximate to the inner surface.

22. The carrier head of claim 19 wherein the retaining ring further includes means for moving the solution from the inner surface to the outer surface as the retaining ring rotates in a single direction.

23. The carrier head of claim 19 wherein the retaining ring further includes means for moving the solution from the outer surface to the inner surface as the retaining ring rotates in a single direction.

24. A carrier head for retaining a micro-device workpiece during at least one of mechanical polishing and chemical-mechanical polishing, the carrier head comprising;

a workpiece holder configured to receive the workpiece; and a retaining ring carried by the workpiece holder, the retaining ring including;

an inner surface;

an outer surface;

a base surface extending at least partially between the inner and outer surfaces;

an annular groove positioned adjacent to the base surface between the inner and outer surfaces; and a plurality of transverse grooves intersecting the annular groove, each of the transverse grooves having an opening at the inner surface, a closed end between the inner surface and the outer surface, and sidewalls between the opening and the closed end, wherein the plurality of transverse grooves includes at least a first transverse groove and an adjacent second transverse groove, wherein the first transverse groove intersects the annular groove at a first angle and the second transverse groove intersects the annular groove at a second angle different than the first angle.

25. The carrier head of claim 24 wherein each of the transverse grooves intersects the annular groove at an angle different than 90 degrees.

26. The carrier head of claim 24 wherein the first transverse groove intersects the second transverse groove.

27. The carrier head of claim 24 wherein at least one of the transverse grooves is curved.

28. The carrier head of claim 24 wherein the retaining ring further includes at least a third transverse groove that extends from the inner surface of the retaining ring to the outer surface of the retaining ring.

29. A machine for polishing micro-device workpieces the machine comprising:

a table having a support surface;

a planarizing pad coupled to the support surface; and a workpiece carrier assembly having a drive system operably coupled to a carrier head, the carrier head comprising:

a workpiece holder configured to receive the workpiece; and a retaining ring carried by the workpiece holder, the retaining ring including:

an inner surface;

an outer surface;

a base surface extending at least partially between the inner and outer surfaces;

an annular groove positioned adjacent to the base surface between the inner and outer surfaces; and a plurality of transverse grooves extending from the inner surface to the annular groove, wherein the plurality of transverse grooves in the retaining ring includes at least a first transverse groove and an adjacent second transverse groove, wherein the first transverse groove intersects the annular groove at a first angle and the second transverse groove intersects the annular groove at a second angle different than the first angle, the transverse grooves terminating before reaching the outer surface.

30. The polishing machine of claim 29 wherein each of the transverse grooves in the retaining ring intersects the annular groove at an angle different than 90 degrees.

31. The polishing machine of claim 29 wherein at least one of the plurality of transverse grooves in the retaining ring is curved.

32. The polishing machine of claim 29 wherein the annular groove in the retaining ring is a first annular groove, and, wherein the retaining ring further comprises a second annular groove positioned adjacent to the first annular groove in the base surface.

33. The polishing machine of claim 29 wherein the annular groove in the retaining ring is a first annular groove, wherein the retaining ring further comprises a second annular groove positioned adjacent to the first annular groove in the base surface, and wherein the plurality of transverse grooves intersect the first and second annular grooves.

34. The polishing machine of claim 29 wherein the retaining ring further includes at least a third transverse groove that extends from the inner surface of the retaining ring to the outer surface of the retaining ring.

* * * * *

UNITED STATES PATENT AND TRADEMARK OFFICE

CERTIFICATE OF CORRECTION

PATENT NO. : 7,326,105 B2
APPLICATION NO. : 11/217151
DATED : February 5, 2008
INVENTOR(S) : Chandrasekaran It is certified that error appears in the above-identified patent and that said Letters Patent is hereby corrected as shown below:

Title page, Item (54), in column 1, line 1, after "RINGS" delete ",".

In column 1, line 1, after "RINGS" delete ",".

In column 8, line 61, in Claim 1, after "including" delete ";" and insert -- : --, therefor.

In column 10, line 65, in Claim 24, after "comprising" delete ";" and insert -- : --, therefor.

In column 11, line 2, in Claim 24, after "including" delete ";" and insert -- : --, therefor.

In column 11, line 31, in Claim 29, after "workpieces" insert -- , --.

In column 12, line 27, in Claim 32, after "and" delete ",".

Signed and Sealed this

Twentieth Day of May, 2008

JON W. DUDAS
*Director of the United States Patent and Trademark Office*